United States Patent [19]

Bensussan et al.

[11] 4,332,091

[45] Jun. 1, 1982

[54] MICROWAVE DRYING DEVICE FOR DRYING PRODUCTS IN FORM OF GRAINS

[75] Inventors: André Bensussan; Guy Azam, both of Buc, France

[73] Assignee: C. G. R. MeV, Buc, France

[21] Appl. No.: 156,465

[22] Filed: Jun. 4, 1980

[30] Foreign Application Priority Data

Jun. 8, 1979 [FR] France ..... 79 14723

[51] Int. Cl.[3] ..... F26B 23/08

[52] U.S. Cl. ..... 34/1; 34/57 R; 219/10.55 A; 219/10.55 F

[58] Field of Search ..... 34/1, 10, 57 R; 219/10.55 A, 10.55 F

[56] References Cited

U.S. PATENT DOCUMENTS

| | | | |
|---|---|---|---|
| 3,555,693 | 1/1971 | Futer . | |
| 3,611,582 | 10/1971 | Hamid et al. | 219/10.55 A |
| 3,688,068 | 8/1972 | Johnson | 219/10.55 A |
| 3,771,234 | 11/1973 | Forster et al. | 34/1 |
| 4,023,279 | 5/1977 | Janda . | |

FOREIGN PATENT DOCUMENTS

| | | |
|---|---|---|
| 2246027 | 3/1974 | Fed. Rep. of Germany . |
| 2319863 | 2/1977 | France . |
| 1053012 | 12/1966 | United Kingdom . |

*Primary Examiner*—Larry I. Schwartz

*Attorney, Agent, or Firm*—Cushman, Darby & Cushman

[57] ABSTRACT

A microwave drying device for drying products in the form of grains, comprising a microwave source, at least one waveguide coupled electromagnetically to the microwave source, means for injecting into this waveguide the product to be treated, means for driving this product in the waveguide, means for causing a forced circulation of dry air in the waveguide, means for discharging the air charged with the humidity given up by the product to be treated, and means for collecting the dried product in this waveguide, wherein the waveguide is closed on itself so as to form a ring, a part of this waveguide forming a channel through which the product to be treated may pass, said channel being connected at its ends to pipes for feeding therein and removing therefrom the product, these pipes forming cut-off waveguide.

8 Claims, 5 Drawing Figures

FIG. 5
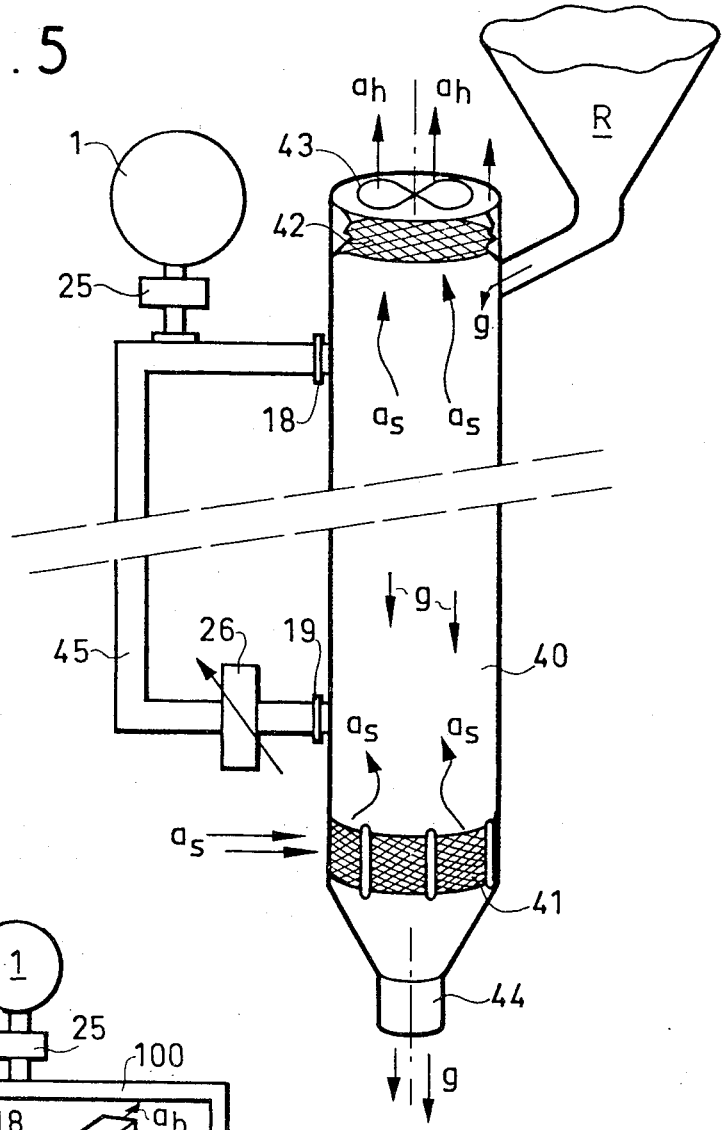
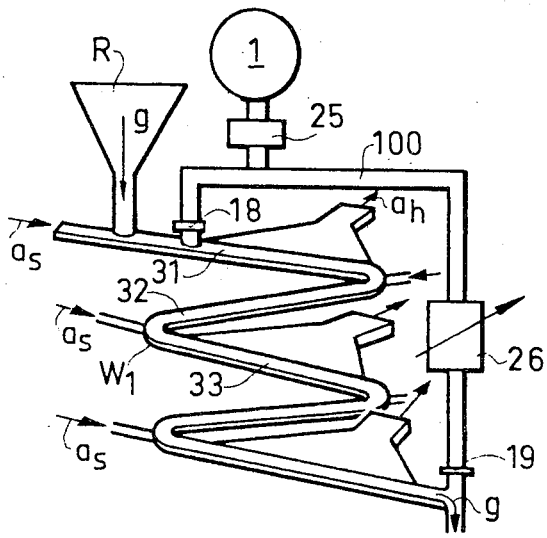
FIG. 4

MICROWAVE DRYING DEVICE FOR DRYING PRODUCTS IN FORM OF GRAINS

BACKGROUND OF THE INVENTION

The present invention relates to a microwave drying device, this device being more particularly intended for drying grains or seeds so as to ensure good preservation thereof.

In fact, grains have a high degree of humidity, which adversely affects their good preservation and causes each year considerable losses of the crops.

A microwave drying device of this kind is known for example from French Pat. No. 2 319 863 or U.S. Pat. No. 3,555,693. The microwave treating system described therein includes a microwave generator, a waveguide through which the radiofrequency or microwave energy from the generator is propagated, means for passing the material to be treated through the waveguide to expose it to the microwave energy and, usually, a dumming load such as a water load isolated from the waveguide by a diaphragm to prevent reflection of energy to the generator.

SUMMARY OF THE INVENTION

It is an object of the invention to provide a microwave drying device for drying products in the form of grains, comprising a microwave source, at least one waveguide electromagnetically coupled to the microwave source, means for injecting into this waveguide the product to be treated, means for driving this product in the waveguide, means for causing a forced circulation of dry air in the waveguide, means for discharging the air with the humidity given up by the product to be treated, and means for collecting the dried product in this waveguide, said waveguide being closed on itself so as to form a ring, a part of this waveguide forming a channel through which the product to be treated may pass, this channel being connected at its ends to pipes for feeding therein and removing therefrom the product, these pipes forming cut-off waveguides.

DESCRIPTION OF THE DRAWINGS

The invention will be better understood and other characteristics will appear from the following description and the accompanying drawings and in which:

FIGS. 2 to 5 show respectively other embodiments of the device of the invention.

DESCRIPTION OF THE PREFERRED EMBODIMENTS

Figure 1:
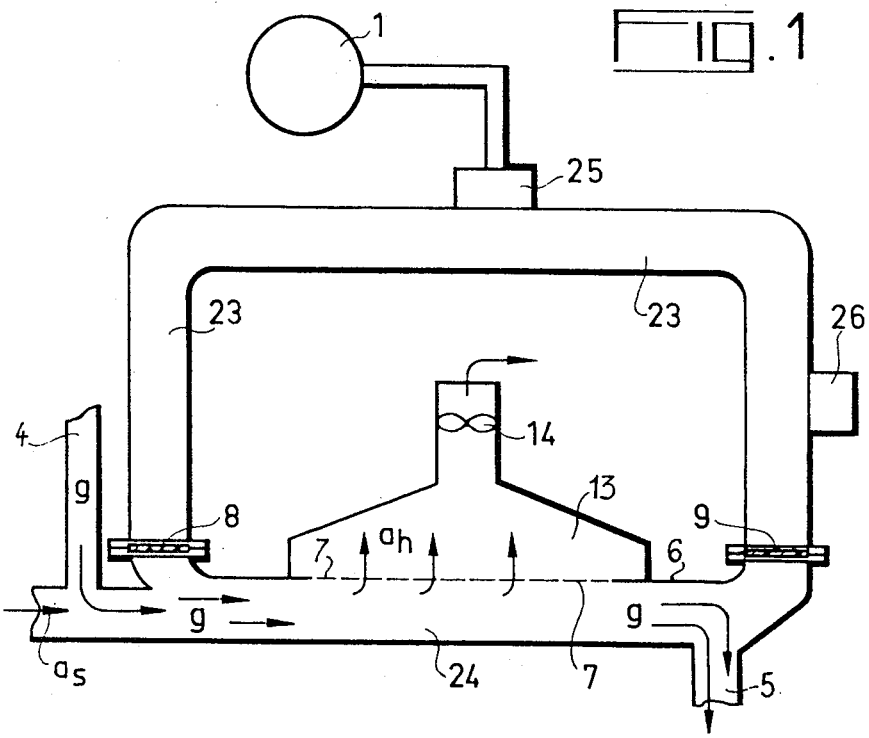
FIG. 1 shows one embodiment of a microwave drying device in accordance with the invention.

The microwave drying device in accordance with the invention more particularly intended for drying grains, comprises in a first embodiment shown in FIG. 1 microwave source 1 electromagnetically coupled by means of a coupling loop or a coupling hole to a microwave waveguide 23. This waveguide has the form of a rectangular ring 23, a part 24 of this ring forming a channel in which the grains flow. Microwave source 1 is coupled to the annular waveguide 23 by means of a directional coupler 25. Such directional coupler insures that the non-absorbed energy is recirculated into the resonant annular waveguide and reflection toward the magnetron is avoided. Therefore, efficiency can be kept high while all of the energy is effectively absorbed by the grain. A phase shifter 26 allows the phase to be adjusted so as to obtain optimum efficiency of the device of the invention.

The waveguide portion 24 of this ring 23 which forms a channel for the flow of the grains, is provided at each of its ends with cut-off waveguide 4, 5, i.e. whose dimensions do not allow propagation of the microwave signal injected into guide 23. One of the walls 6 of waveguide portion 24 has a plurality of orifices therethrough, or better still is formed from a metal grid 7 whose mesh is small compared with the size of the grains to be treated and also small compared with the wavelength of the microwave signal injected into channel-forming guide 24. This grid 7 which forms a non-transparent wall for the microwave energy allows the humid air $a_h$ to be discharged resulting from the treatment of the grains. Windows 8, 9 made from an electrically insulating material (made from ethylene polytetrafluor for example) sealingly separate the waveguide portion 24 in which the grains must flow and the other portion of the waveguide 23 being electromagnetically coupled to the microwave source 1. Above the wall of the waveguide 24 formed by grid 7 is disposed a hood 13 for collecting the watervapor-loaded air coming from the treatment of the grains. A fan 14 provides for discharge of this humid air to the outside.

In operation, the grains g are fed by means of a dry-air jet into the channel formed by the waveguide portion 24. These grains g are then subjected in waveguide portion 24 to a microwave electric field. The dielectric heating of these grains thus effected removes a given amount of the water which they contain. The dry air $a_s$ introduced with the grains g is then charged with water vapor, and the humid air $a_h$ after passing through grid 7, passes into hood 13 then is discharged by means of fan 14. The suitably dried grains g leave channel 3 through cut-off waveguide 5 for storing.

The degree to which the grains are dried is adjustable. In fact, it depends on the microwave power dissipated therein, this power P being proportional to the square of the microwave electric field E, to the frequency f used and to the dielectric constant $\epsilon$ presented by the grains, i.e.:

$$P = k.E^2.f.\epsilon$$

k being a numerical coefficient dependent on the nature of the grains.

It may be advantageous to use a microwave source operating at about 2840 MHz for example, this frequency being the one currently used in the construction of microwave cookers which are equipped with low cost-price magnetrons and having microwave output powers of several kilowatts.

Figure 3:
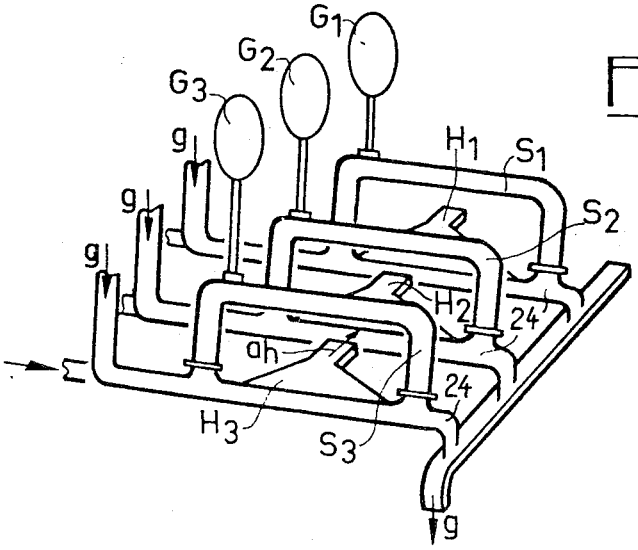
Figure 2:
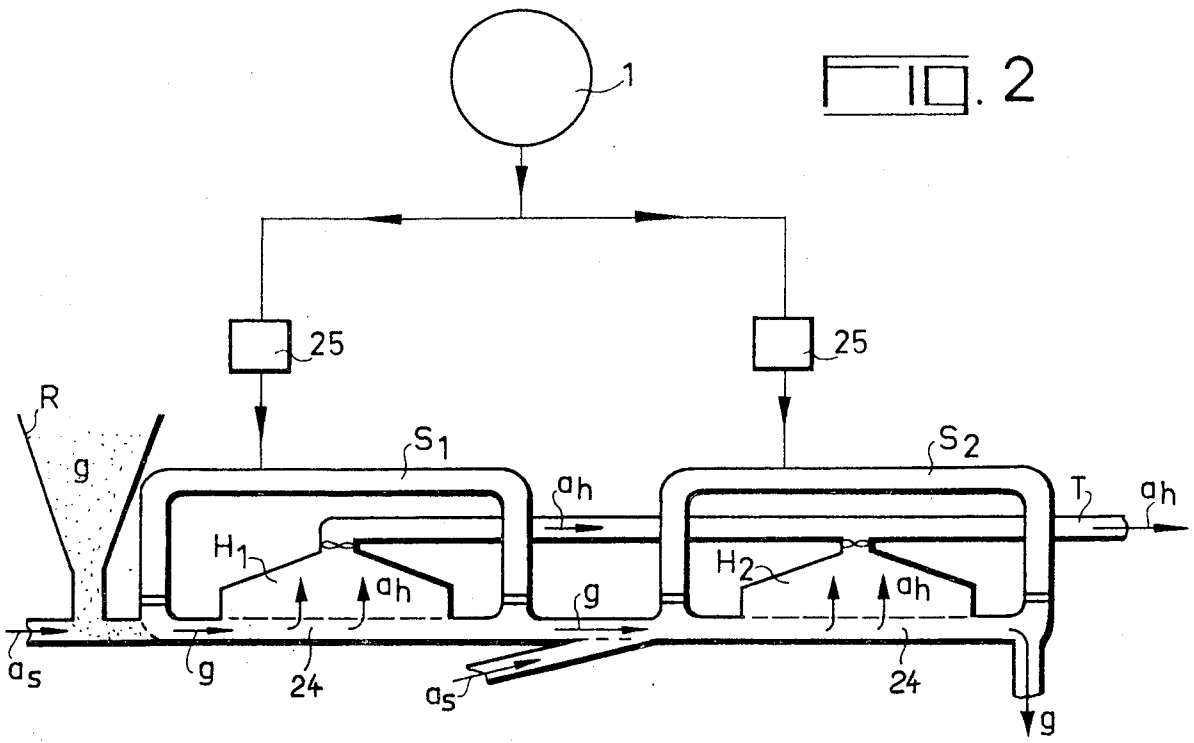

The embodiment described in FIG. 1 is not limiting, in particular, it is possible to place in series, or in parallel, n devices $S_1$, $S_2$, . . . of the type previously described, as shown in FIGS. 2 and 3. Hoods $H_1$, $H_2$ . . . are connected to discharge or recycling piping T (FIG. 2). The microwave energy injected into the different waveguides $S_1$, $S_2$ . . . may be supplied from a single microwave source 1 (FIG. 2) or from n microwave sources $G_1$, $G_2$, $G_3$ . . . as shown in FIG. 3 where channels 24 are disposed in parallel in the discharge piping T.

FIG. 4 shows another embodiment of the grain-drying device in accordance with the invention. In this variation, the microwave source 1 is electromagnetically coupled to a waveguide 100. The both ends of said waveguide 100 are coupled to a guide-channel $W_1$ which is accordion-folded in such a manner to form a succession of inclined channel-portions 31, 32, 33 having one of their lateral walls formed at least partially by a fine-mesh grid (not shown in FIG. 4). A microwave phase shifter 26 enables the phase shift of the microwave injected into the waveguide to be adjusted at the input and the output of the waveguide 100. Windows 18, 19 transparent at the microwave are placed at the ends of the waveguide 100, preventing the grains g from penetrating into waveguide 100.

Another embodiment of the grain-drying device of the invention shown in FIG. 5 comprises a circular-section cylindrical waveguide 40 disposed vertically and forming the channel in which the grains flow. This waveguide channel 40 comprises, at its lower part, a sleeve 41 formed from a metal grid rigidly fixed to the waveguide 40. This waveguide 40 is closed, at its upper part, by a grid plate 42 circular in shape, above which is placed a fan 43. Waveguide 40 is terminated at its lower part by a pipe 44 forming a cut-off waveguide, this pipe 44 being intended for discharging the treated grains. A microwave source 1 is coupled electromagnetically to a waveguide 45 both ends of which are coupled to waveguide channel 40. As in the examples previously described, the microwave circuit associated with microwave source 1 comprises a directional coupler 25 and a phase shifter 26 for adjusting the phase shift of the microwave considered at the ends of waveguide 45. Windows 18 and 19 transparent to the microwave emitted by microwave source 1 are placed at both ends of waveguide 45.

In operation, the grains g contained in silo R are gravity fed into waveguide 40 forming a heating column. A dry-air jet $a_s$, the pressure of which is determined so as to appreciably slow down the speed of the grains descending wave-guide 40 by gravity, passes through this waveguide 40 from bottom to top. This motion from bottom to top of the dry air $a_s$ penetrating into waveguide 40 through grid 41 is obtained by the depression created in waveguide 40 by means of fan 43 (or a turbine). Fins (not shown) may create a swirling movement of dry air $a_s$ in waveguide 40, so that the grains occupy different positions in the heating microwave electric field created in waveguide 40. The grains give up their humidity during their descent in the heating column formed by waveguide 40, the air $a_h$ charged with this humidity being discharged at the upper part of the heating column 40 and the dried grains being removed through pipe 44.

What we claim is:

1. A microwave drying device for drying products in the form of grains, comprising a microwave source, at least one waveguide coupled electromagnetically to the microwave source, means for injecting into this waveguide the product to be treated, means for driving this product in the waveguide, means for causing a forced circulation of dry air in the waveguide, means for discharging the air charged with the humidity given up by the product to be treated, and means for collecting the dried product in this waveguide, wherein the waveguide is closed on itself so as to form a ring, and coupled to said source by directional coupler for injecting radiation so as to cause recirculation in one direction around said closed loop, a part of this waveguide forming a channel through the product to be treated may pass, said channel being connected at its ends to pipes for feeding thereinto and removing therefrom the product, these pipes forming cut-off waveguides.

2. A microwave device as claimed in claim 1, wherein one of the lateral walls of the channel is formed at least partially by a fine-mesh grid allowing the humid air to pass therethrough but preventing the product to be treated from passing therethrough.

3. A microwave device as claimed in claim 2, wherein a hood for discharging the humid air is disposed above the grid and a fan is placed at the outlet of the hood.

4. A microwave device as claimed in claim 1, and comprising a plurality of waveguides closed on itself to form rings, a part of each of said waveguides forming a channel through which passes the product to be treated, said channels of said waveguides being disposed in series.

5. A microwave device as claimed in claim 1, and comprising a plurality of waveguides closed on itself to form rings, a part of each of waveguides forming a channel through which passes the product to be treated, said channels being disposed in parallel in a piping designed for discharging the product to be treated.

6. A microwave device as claimed in claim 1, wherein said channel is accordion-folded in such a manner to form a succession of inclined channel portions having one lateral wall formed at least partially by a line-mesh grid enabling the humid air to pass therethrough but preventing the product to be treated from passing therethrough.

7. A microwave device as claimed in claim 6, wherein said waveguide is provided with a phase shifter which enables the phase shift of the microwave issued from said source and injected into said waveguide to be adjusted at the input and the output of said channel.

8. A microwave device as claimed in claim 1, wherein said waveguide is twice folded and both ends of which are open into the channel which is a circular section cylindrical waveguide vertically disposed, said channel comprising at its lower part a sleeve formed from a grid rigidly fixed to said channel, said channel being closed at its upper part by a grid plate circular in shape above which is placed a fan, said channel being terminated at its lower part by a pipe forming a cut-off waveguide and designed for discharging the treated product.

* * * * *